US005692849A

United States Patent [19]

Kiyomi

[11] Patent Number: 5,692,849

[45] Date of Patent: Dec. 2, 1997

[54] FILE FOLDER

[75] Inventor: Takio Kiyomi, Kyoto, Japan

[73] Assignee: Kokuyo Co., Ltd., Osaka, Japan

[21] Appl. No.: 553,275

[22] PCT Filed: Jun. 28, 1995

[86] PCT No.: PCT/JP95/01295

§ 371 Date: Jun. 4, 1996

§ 102(e) Date: Jun. 4, 1996

[87] PCT Pub. No.: WO96/07549

PCT Pub. Date: Mar. 14, 1996

[30] Foreign Application Priority Data

Sep. 5, 1994 [JP] Japan ..... 6-211478

[51] Int. Cl.[6] ..... B42F 7/00; B42F 13/30; B42F 21/06

[52] U.S. Cl. ..... 402/73; 402/70; 402/77; 281/29; 281/35; 281/37

[58] Field of Search ..... 402/48, 52–54, 402/60, 2, 70–78; 281/21.1, 22, 24, 27.3, 28, 29, 35–37

[56] References Cited

U.S. PATENT DOCUMENTS

| | | | |
|---|---|---|---|
| 813,150 | 2/1906 | Hiscock | 402/77 X |
| 845,390 | 2/1907 | Baugman et al. | 281/27.3 X |
| 2,549,306 | 4/1951 | Greene | 402/74 X |
| 3,891,070 | 6/1975 | Montanari | 402/76 X |
| 4,011,940 | 3/1977 | Neal et al. | 402/70 X |
| 4,219,951 | 9/1980 | Schmidt | 402/75 X |
| 4,222,190 | 9/1980 | Solomon | 402/75 X |
| 4,294,558 | 10/1981 | Errichiello | 402/75 |
| 4,466,638 | 8/1984 | Miskin | 402/77 X |
| 4,588,321 | 5/1986 | Egly | 402/77 |
| 4,856,817 | 8/1989 | Moor | 281/37 X |
| 4,997,207 | 3/1991 | Feldman | 402/73 X |
| 5,190,127 | 3/1993 | Cummings | 402/77 X |
| 5,209,593 | 5/1993 | Ros | 402/77 |
| 5,213,433 | 5/1993 | An | 402/73 X |
| 5,267,804 | 12/1993 | Baumgarten | 402/73 X |

FOREIGN PATENT DOCUMENTS

| | | | |
|---|---|---|---|
| 466250 | 6/1950 | Canada | 281/29 |
| 0 375 925 | 11/1989 | European Pat. Off. | 402/70 |
| 0 559 444 | 9/1993 | European Pat. Off. | 402/73 |
| 24 48 999 | 4/1976 | Germany | 402/70 |
| 8236741 | 6/1983 | Germany | 402/70 |
| 49-1014 | 1/1974 | Japan . | |
| 55-166679 | 12/1980 | Japan . | |
| 58-155269 | 10/1983 | Japan . | |
| 61-148674 | 9/1986 | Japan . | |
| 63-70378 | 5/1988 | Japan . | |
| 2-68178 | 5/1990 | Japan . | |
| 3-20193 | 2/1991 | Japan . | |
| 3-52184 | 5/1991 | Japan . | |
| 4-2685 | 1/1992 | Japan . | |
| 221947 | 6/1942 | Switzerland | 281/29 |
| 552787 | 4/1943 | United Kingdom | 281/29 |
| 1376184 | 12/1974 | United Kingdom . | |
| 2 203 097 | 10/1988 | United Kingdom | 402/75 |
| 092021523 | 12/1992 | WIPO | 402/70 |
| 093 003 932 | 3/1993 | WIPO | 402/60 |

*Primary Examiner*—Daniel W. Howell
*Assistant Examiner*—Julie A. Krolikowski
*Attorney, Agent, or Firm*—Banner & Witcoff, Ltd.

[57] ABSTRACT

A file folder improved in stiffness otherwise to fall down or deform when the S-binding file folder is placed in the E-type storage mode comprises a pair of foldable front and rear covers 4 and 5, a back cover 6 integrally located between and connected to them, and a binding fastener 3 fixedly attached on the inner face of the back cover 6 or the inner face of one of the foldable covers 4 and 5 near the back cover 6. A top wall section 8 and a tip wall section 9 are provided along the top and tip edges of one of the covers 4 and which detachably engage with the another cover 5.

18 Claims, 11 Drawing Sheets

FILE FOLDER

FIELD OF THE ART

This invention relates generally to file folders and, more particularly, to file folders used in an office or the like.

BACKGROUND ART

Various types of file folders are conventionally known. These prior-art folders are generally made of flat and rigid sheet material such as cardboard and synthetic plastics, and include a pair of front and rear covers which are integrally connected with a back cover via fold lines or hinge sections. A binding fastener is fixedly attached to the inner face of the back cover as by bonding, welding or riveting.

A typical prior-art file folder includes a pair of front and rear covers having a longitudinal length longer than the lateral width and is designed to bind or secure a plurality of loose papers along their longer edges by a binding fastener. This type of paper binding will hereinafter be referred to as the "S-binding". In the conventional practice, the file folder with S-bound papers is usually kept or otherwise stored upright on a bookshelf or in a cabinet with the back cover to which the fastener is fixed standing upright in a vertical direction. This manner of storing will hereinafter be referred to as the "S-type storage".

Meanwhile, it is of late attempted for the purpose of efficient use of a limited space to place such file folders on a support shelf in such a position that the back cover is kept above and extends horizontally, with the loose papers that are S-bound within the file folder being suspended vertically from its binding fastener. This manner of storing will hereinafter be referred to as the "E-type storage".

However, when the S-binding file folder is kept in the E-type storage mode on a long time basis, the file folder is likely to fall down because of the weight of the papers which has been applied to the file folder to deform it into parallelogram. For a solution to this problem it is conceived that a wall section is formed around the cover of the file folder to make the file folder into a box shape when closed, which improves the stiffness of the file folder. However, if the file folder is made in the shape of a box, the wall section formed around the cover of the file folder poses an obstacle for a finger to access papers when the filing folder is opened for turning over a page of papers.

SUMMARY OF THE INVENTION

It is an object of the invention to provide a new and improved file folder free from these and other problems inherent in the prior-art file folders.

In order to realize this object, a new arrangement is provided for the file folder. The file folder in accordance with the invention comprises a pair of foldable covers, a back cover integrally connected to the foldable covers, and a binding fastener fixedly provided at the inner face of the back cover or the inner face of the foldable covers near the back cover, and is characterized in that a top wall section and a tip wall section which make detachable engagement with the other foldable cover are provided along the top edge and the tip edge of one of the foldable covers.

In accordance with the arrangement, since along the top edge and the tip edge of one of the foldable covers provided are the top wall section and the tip wall section which detachably engage with the another foldable cover, the file folder comes into the shape of a box when the file folder is closed because the top and tip wall sections formed on one foldable cover engage with the another foldable cover. As a result of this, the file folder becomes stiffer, which in turn resists against the force which deforms the file folder into parallelogram. The file folder will never be deformed even though kept in E-type storage mode on a long time basis. Moreover, since one of the foldable covers is provided with no wall section at the bottom edge thereof, the papers bound inside the file folder are accessible through the bottom portion thereof in turning over the papers when the file folder is opened for use.

The file folder in accordance with the invention may be the one which comprises a pair of foldable covers, a back cover integrally connected to the foldable covers, and a binding fastener fixedly provided at the inner face of the back cover or the inner face of one of the foldable covers near the back cover, and is characterized in that along the top, bottom and tip edges of one of the foldable covers provided with a top wall section, a bottom wall section and a tip wall section respectively which detachably engage with the another foldable cover and that a cut-out portion which extends close to the inner face of one of the foldable covers is formed in the bottom wall section which faces the user when the file folder is opened for use.

In accordance with the arrangement, since along the top, bottom and tip edges of one of the foldable covers provided are the top wall section, the bottom wall section and the tip wall section which detachably engage with the another foldable cover, the file folder becomes stiffer than the previously described one. In addition, although the wall section is formed entirely around one of the foldable covers, the cut-out portion is formed in the bottom wall section which faces the user when the file folder is opened for use, resulting in easy access to the papers bound inside the file folder like the previously described file folder.

In the arrangement of the file folder described above in order to make opening operation easy in addition to keep the shape when the file folder is closed, it is preferable that the foldable covers are made elastically transformable, that a cut-out portion is formed on the tip wall section to allow the foldable covers to elastically transform for approaching each other and that an elastic stopper is provided between the foldable covers which makes engagement with itself by making use of the closing action of the foldable covers as well as releases engagement by making use of the elastic transformation of the foldable covers.

In the above case, it is preferable that the tip wall section provided on one of the foldable covers has an upper and down abutting portions at the top and bottom edges thereof which make abutting engagement with the another foldable cover and the above-mentioned cut-out portion between the bottom edge of the upper abutting portion, and the top edge of the down abutting portion and that the elastic stopper comprises inserting members provided on one of the foldable covers above the bottom edge of the upper abutting portion and below the top edge of the down abutting portion, receiving members provided on the another foldable cover and into which the inserting members are to be fittingly inserted when the foldable covers are closed, resistance giving elements which give the inserting members a required resistance against being released from the receiving members.

For coping with either the E-type or S-type storage mode, a label mount portion is preferably provided on each of the back cover and the top wall section, and a finger access portion is preferably provided each of thereon for easy pick up of the file folder out of the storage space.

If each of the back cover and the top wall section is provided with a label mount portion, either one of the label mount portions comes to face toward the user whether the file folder is in the S-type storage mode or in the E-type storage mode. As a result of this, the label mount portion will always be exposed to the user.

If each of the back cover and the top wall section is provided with a finger access portion, either one of the finger access portions comes to face toward the user whether the file folder is in the S-type storage mode or in the E-type storage mode. As a result of this, the file folder can be picked up out of the storage space in both the E-type and S-type storage mode.

BEST MODES OF EMBODYING THE INVENTION

Figure 1:
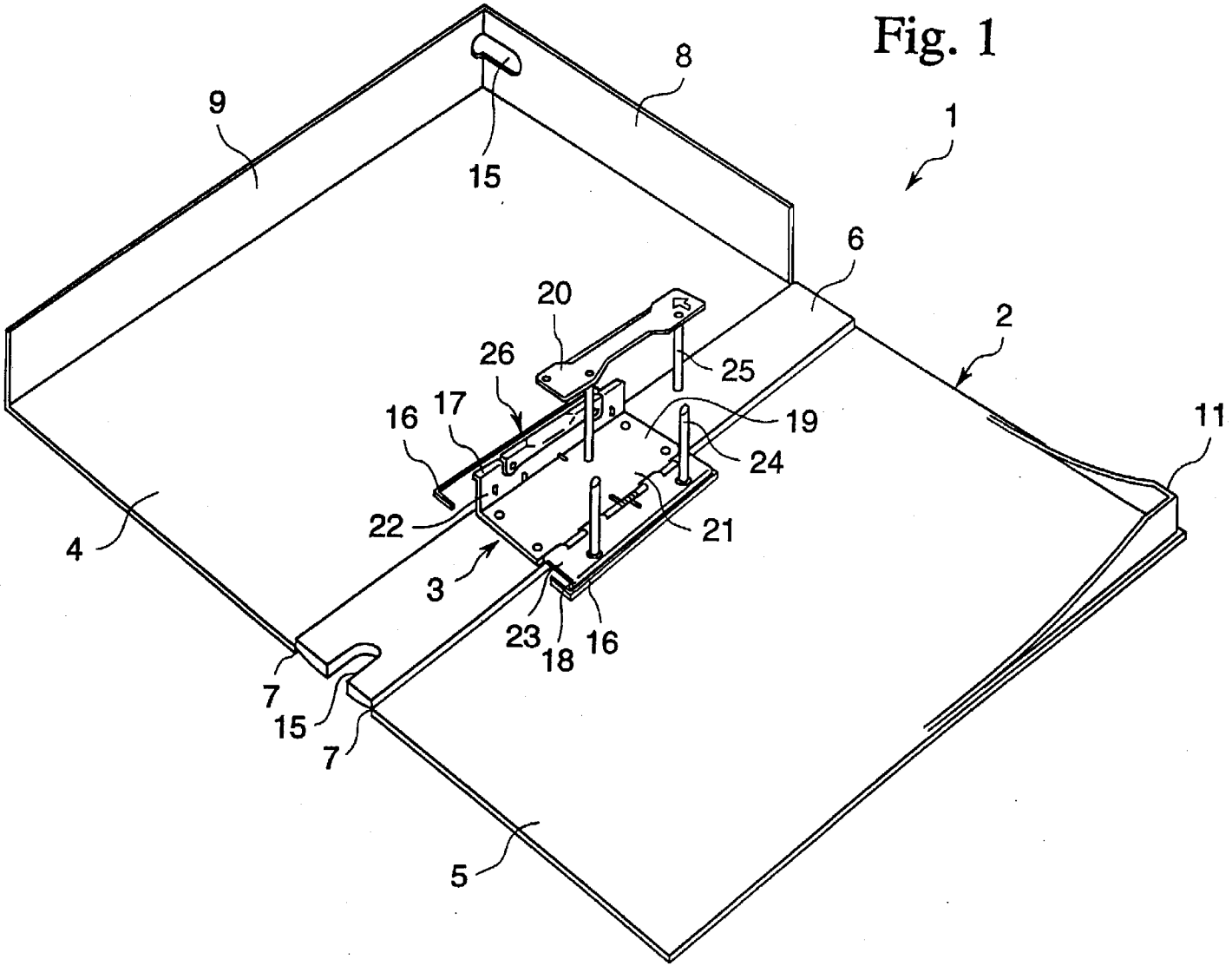
FIG. 1 is a perspective view of a file folder in accordance with one preferred embodiment of the invention.
Figure 2:
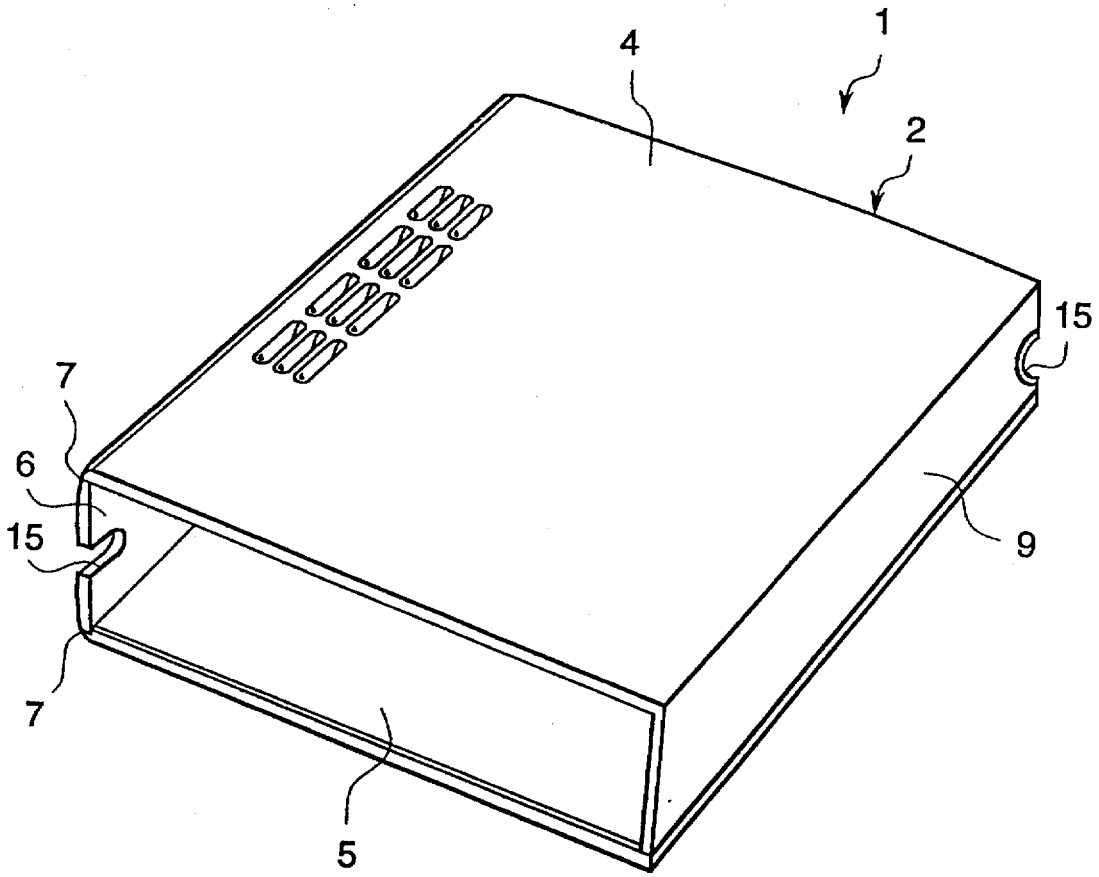
FIG. 2 is a perspective view of the file folder of the embodiment shown in closed.

Referring now to FIGS. 1 to 4, there is illustrated a file folder in accordance with an embodiment of the invention.

The file folder 1, as shown in FIGS. 1 to 4, essentially consists of a folder body 2 and a binding fastener 3 which is securely attached to the inner face of the folder body 2.

The folder body 2 is integrally formed or molded of a suitable synthetic plastic material, and comprises a pair of a front cover 4 and a rear cover 5 each of which is oblong, namely having a longitudinal length larger than the width, and a back cover or a spine 6 to which the front cover 4 and the rear cover 5 are foldably connected via hinge sections 7, a top wall section 8 formed along the top edge of the front cover 4 and detachably engaged with the rear cover 5, a tip wall section 9 formed along the tip edge of the front cover 4 and detachably engaged with the rear cover 5, and an engaging wall section 11 formed from the center near the top edge to the center near the tip edge of the rear cover 5.

More specifically, the top wall section 8 is formed to project vertically and inwardly from the top edge of the front cover 4, and has a height generally the same as the width of the back cover 6 and a thickness generally the same as the thickness of the front cover 4. The tip wall section 9 is formed to project vertically and inwardly from the tip edge of the front cover 4, and has a height generally the same as the width of the back cover 6 and a thickness generally the same as the thickness of the front cover 4. The left edge of the top wall section 8 is continuously connected to the top edge of the tip wall section 9 with forming general right angle. The engaging wall section 11 is integrally formed on the rear cover 5 with drawing a gentle ascending curve starting from half the width of the top edge of the rear cover 5 to the tip edge thereof parallel to and apart from the top edge as much as the thickness of the top wall section 8 and drawing a gentle ascending curve starting from half the longitudinal length of the tip edge of the rear cover 5 to the top edge thereof parallel to and apart from the tip edge thereof as much as the thickness of the tip wall section 9, and two ascending curves are connected in the upper right-hand corner of the rear cover 5.

Figure 3:
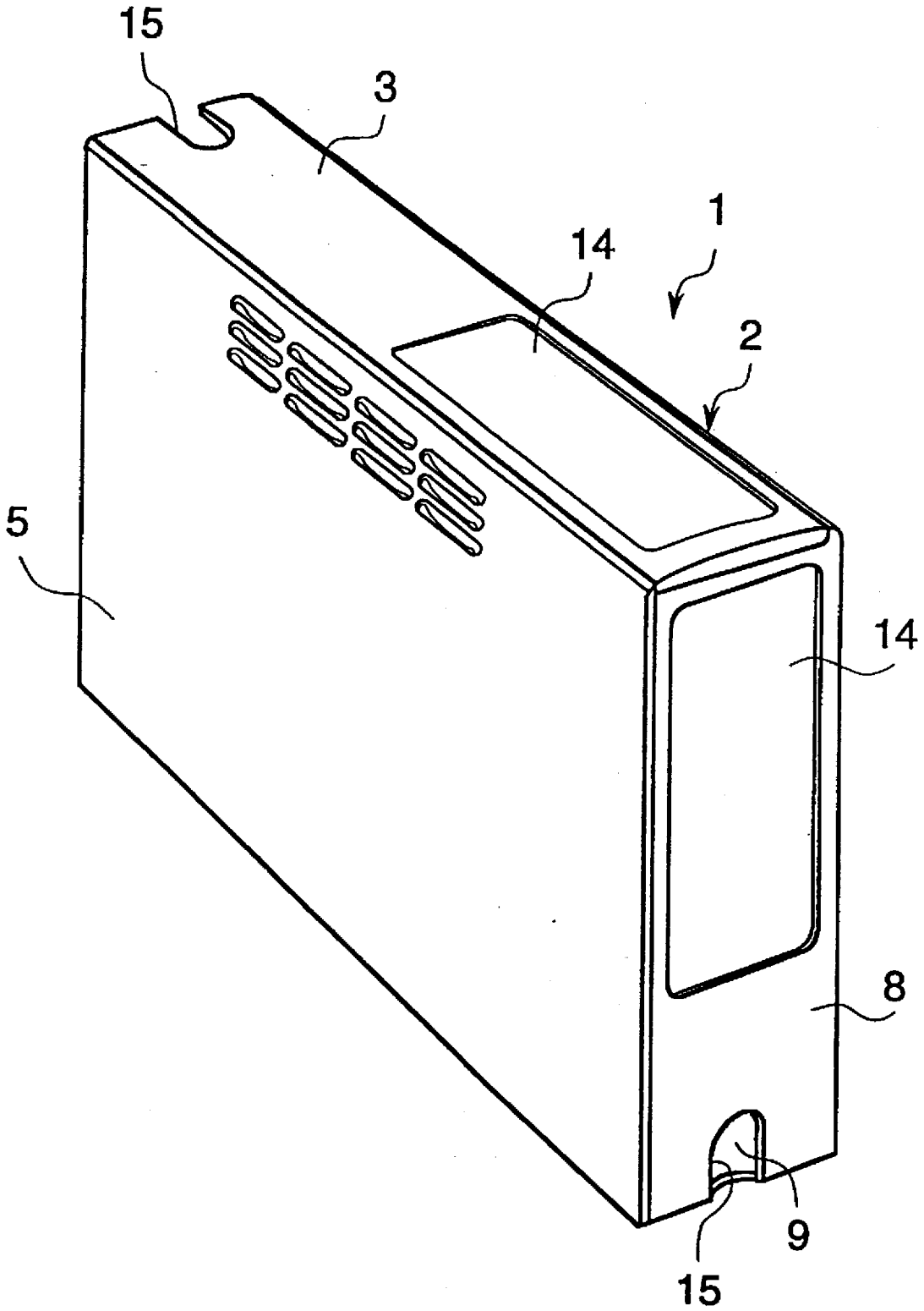
FIG. 3 is a perspective view showing the file folder of the embodiment in an E-type storage mode.
Figure 4:
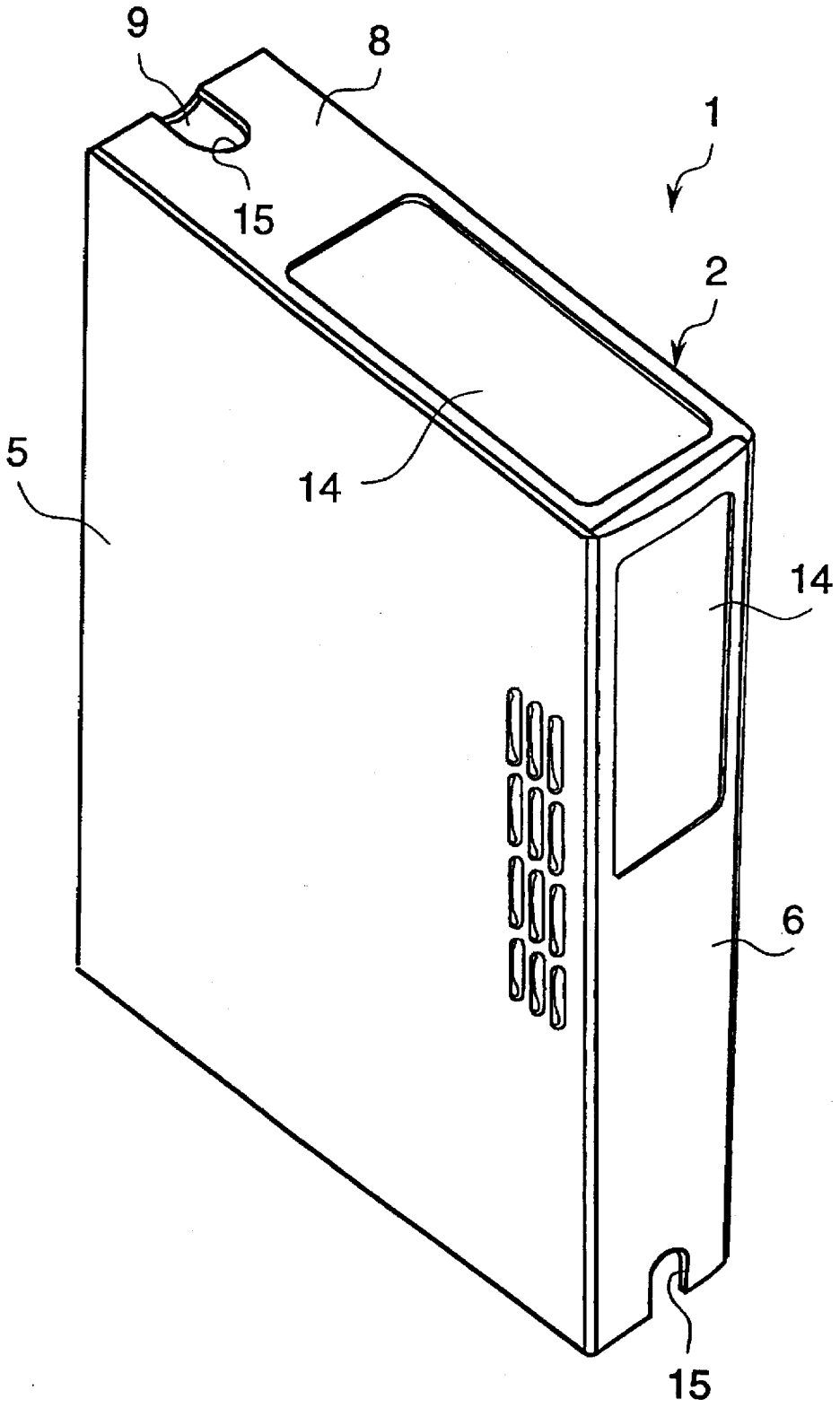
FIG. 4 is a perspective view shown the file folder of the embodiment in an S-type storage mode.

Each of the back cover 6 and the top wall section 8 is, as shown in FIG. 3, provided with a label mount portion 14 for detachably attaching a label. The label mount portion 14 is formed square having a depth generally half of the thickness of the folder body 2 and each of the label mount portions 14 is provided on the upper side of the back cover 6 and the top wall section 8 respectively when the file folder 1 is in stock. Each of the back cover 6 and the top wall section 8 is provided with a finger access portion 15. The finger access portion 15 is used for drawing the file folder 1 out of a stocked place and has the shape of a cut-out having a size to facilitate an access of a finger. The finger access portion 15 is provided on each of the down side of the back cover 6 and the top wall section 8 when the file folder 1 is placed in stock.

The binding fastener 3 is riveted to the inside of the back cover 6 at the longitudinal center thereof. There are provided, at the inner faces of the front and rear covers 4 and 5, engaging ribs 16, each of which is a projection of a planar shape of a widened "U" having an inner longitudinal length approximately equal to the outer longitudinal length of the binding fastener 3. The engaging ribs 16 may have a height nearly equal to the width of the abutting flanges 17 and 18 of the binding fastener 3 to be described hereinafter. It should be noted that the engaging ribs 16 are formed integrally with the front and rear covers 4 and 5, and are located symmetrically with respect to the center line of the back cover 6 in positions that are most suitable for the ribs to be brought into engagement with the flange portions 17 and 18 of the fastener 3.

The binding fastener 3 includes a base member 19 riveted to the folder body 2 and a removably or detachably mounted clamp member 20 and binds papers by means of coaction with a binding rod 24 provided on the base member 19 and the clamp member 20. The base member 19 is of a suitable sheet metal and comprises a mounting base 21, an upright fixed wall section 22 extending vertically and upwardly from one longitudinal edge of the mounting base 21, and a movable wall section 23 pivotally connected to the other longitudinal edge of the mounting base 21 and on which a pair of the binding rods 24 project. The clamp member 20 is brought into engagement with the inner face of the upright fixed wall section 22 by detachably inserting shaft members 25 of the clamp member 20 into the binding rods 24 and then uprighting the movable wall section 23. A locking means for locking the clamp member 20 to the upright fixed wall section 22 may be the same as that is well known in the art and no further reference to the locking means 26 is given here. The free end of both the upright fixed wall section 22 and the movable wall section 23 are bent outwardly to form flange portions 17 and 18.

With the above-described construction of the file folder 1, when the folder body 2 is closed, the inner faces of both the top wall section 8 and the tip wall section 9 formed on the front cover 4 make engagement with the outer face of the engaging wall section 11 formed on the rear cover 5, thereby to be formed into a shape of a box. This greatly improves the stiffness of the folder body 2 and gives resistance against the weight or load acting on the folder body 2 to deform it into parallelogram in addition, since no wall is provided on the bottom edge of the front cover 4, the papers bound inside the folder body 2 are directly accessible from the bottom edge by fingers when the folder body 2 is opened for use.

Since the label mount portion 14 is provided on each of the back cover 6 and the top wall section 8, when the file folder 1 is to be drawn out of a shelf, either one of the label mount portions 14 comes to face toward the user whether the file folder 1 is in the S-type or E-type storage mode. As a result of this, the file folder 1 can be drawn out of the shelf with ease whether in the S-type storage mode or in the E-type storage mode, thereby to improve handling.

Further, the flange portions 17 and 18 make abutting engagement with the inner face of the engaging ribs 16 when the folder body 2 is closed. In this state, when the file folder 1 is placed on a shelf in the E-type storage mode, i.e. placed upright on the shelf so that the back cover 6 is positioned above and oriented horizontally, the loose papers secured to or bound by the file folder 1 are suspended by the binding fastener 3. In this E-type storage mode, the flange portions 17 and 18 of the binding fastener 3 rest on and are supported by the engaging ribs 16 of the folder body 2, and the weight or load of the whole papers acting on the binding fastener 3 is supported by the front and rear covers 4 and 5 on which the engaging ribs 16 are formed, thereby to almost diminish the weight acting on the back cover 6. As a result of this, an excessive load of the bound papers will not act on the hinge sections 7 provided on the border between the front and rear covers 4 and 5 and the back cover 6, thereby to prevent it effectively from being distorted, which in turn improves durability of the folder body 2.

To keep the file folder 1 with S-bound papers on a shelf in an S-type storage mode, the vertical distance between adjacent two shelves must be selected on the basis of the longitudinal length of the folder body 2. However, with the above-mentioned arrangement of the file folder 1, since it is possible to keep the file folders 1 in the E-type storage mode, the vertical distance between the neighboring shelves may be selected on the basis of the shorter lateral length of the folder body 2, which makes room for additional shelves when a plurality of shelves are to be set up in a limited space. In fact, when the file folder 1 is stored in this manner, for example, approximately 20% reduction in the storage space can be achieved.

In addition, since the engaging ribs 16 are generally formed in the widened "U"-shape, even if the file folder 1 is kept in the S-type storage mode, the lower ends of the flanges 17 and 18 as well as the lower ends of the fixed and movable wall sections 22 and 23 rest on and are supported by the engaging ribs 16. Therefore, the load of the whole papers bound by the fastener 3 is distributed throughout and supported by the front and rear covers 4 and 5 as well as the back cover 6 when the file folder 1 is kept in S-type storage mode, resulting in the same desirable results and advantages as a file folder kept in the E-type storage mode.

Figure 5:
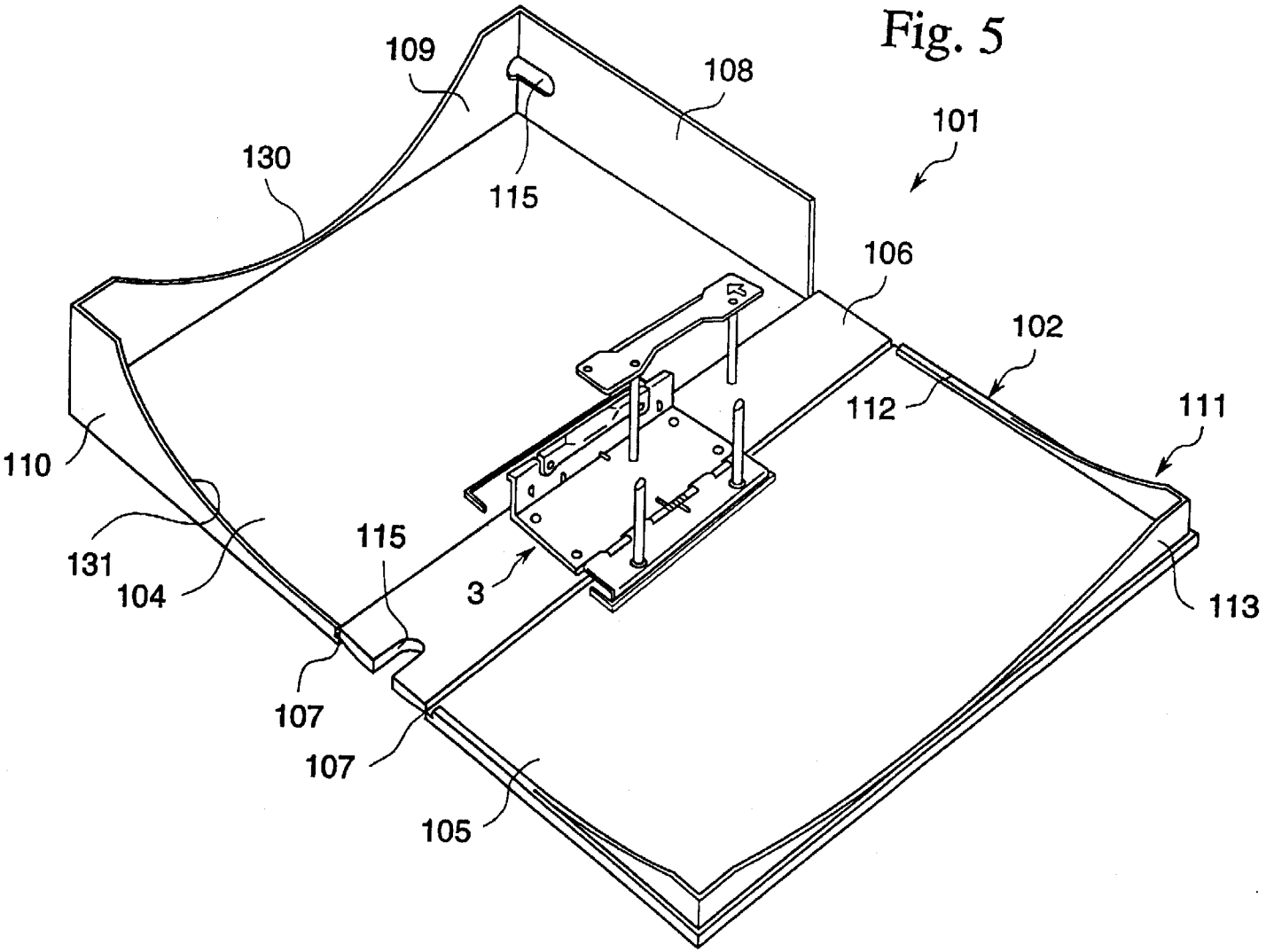
FIG. 5 is a perspective view of a file folder in accordance with another preferred embodiment of the invention.
Figure 6:
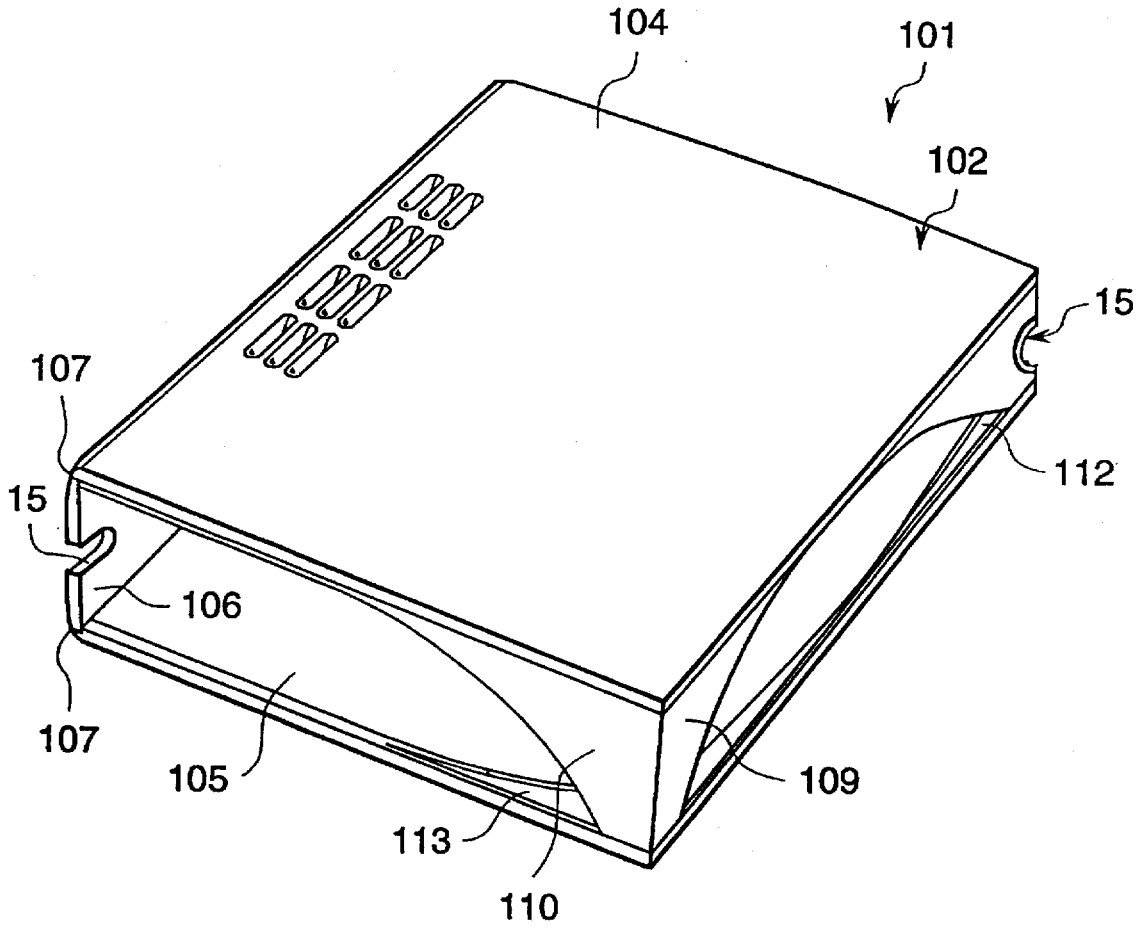
FIG. 6 is a perspective view of the file folder of the embodiment shown in closed.
Figure 7:
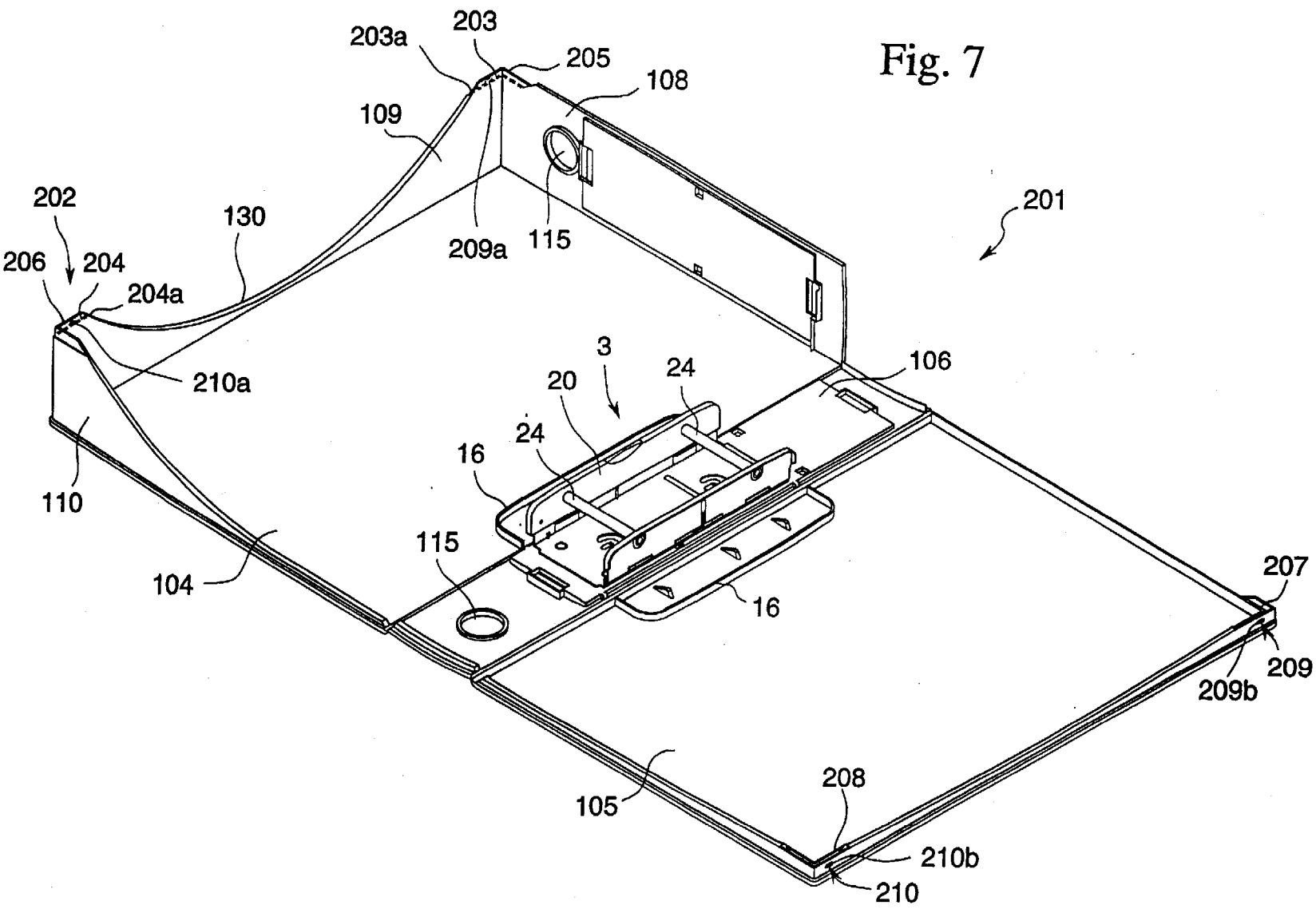
FIG. 7 is a perspective view of a file folder in accordance with further preferred embodiment of the invention.
Figure 8:
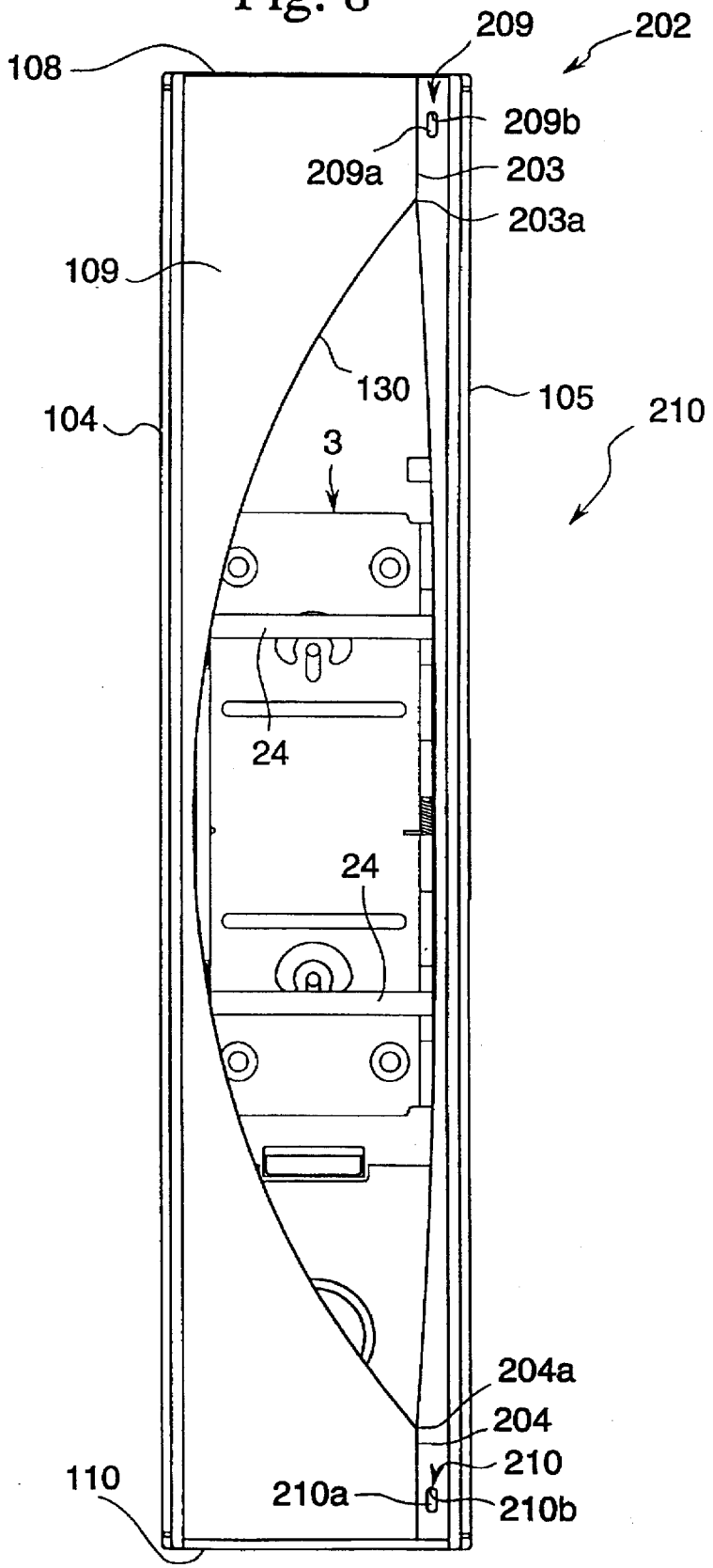
FIG. 8 is a front view of the file folder of the embodiment shown in closed.

Now referring to FIGS. 5 and 6, there is illustrated a file folder 101 according to another embodiment of the invention.

The file folder 101 shown in FIGS. 5 and 6 comprises a folder body 102 and a binding fastener 3 securely attached to the inside of the folder body 102.

The folder body 102 is integrally formed or molded of a suitable synthetic plastic material, and comprises a pair of a front cover 104 and a rear cover 105 each of which is oblong, namely having a longitudinal length larger than the width, and a back cover or a spine 106 to which the front cover 104 and the rear cover 105 are foldably connected via hinge sections 107, a top wall section 108 formed along the top edge of the front cover 104 and detachably engaged with the rear cover 105, a bottom wall section 110 formed along the bottom edge of the front cover 104 and detachably engaged with the rear cover 105, a tip wall section 109 formed along the tip edge of the front cover 104 and detachably engages with the rear cover 105, and an engaging wall section 111 formed on the top, front and bottom edges of the rear cover 105. In addition, cut-out portions 130 and 131 which extend close to the inner face of the front cover 104 are provided on both the bottom wall section 110 and the tip wall section 109, both of which face toward the user when the folder body 102 is to be opened for use.

More specifically, the top wall section 108 is formed to project vertically and inwardly from the top edge of the front cover 104, and has a height generally the same as the value which is the height of the base portion 112 to be referred hereinafter of the engaging wall section 111 formed on the rear cover 105 subtracted from the width of the back cover 106 and a thickness generally the same as the thickness of the front cover 104. The tip wall section 109 is formed to project vertically and inwardly from the tip edge of the front cover 104 and continuous to the left edge of the top wall section 108, and has a height and the thickness generally the same as those of the top wall section 108. The bottom wall section 110 is formed to project vertically and inwardly from the bottom edge of the front cover 104 and continuous to the bottom edge of the tip wall section 109, and has a height and the thickness generally the same as those of the top wall section 108 and the tip wall section 109. In addition, the tip wall section 109 is provided with a cut-out portion 130 which draws a gentle concave curve starting from a position at an appropriate distance from one of the ends of the tip wall section 109 to a position at an appropriate distance from the other end thereof and which extends close to the inner face of the front cover 104 at the longitudinal center thereof. The bottom wall section 110 is provided with a cut-out portion 131 which draws a gentle ascending curve starting from a position at an appropriate distance from one of the ends of the bottom wall section 110, extending close to the inner face of the front cover 104 at generally two thirds of the width of the bottom wall section 110 and then drawing a horizontal straight line which reaches the other end of the bottom wall section 110.

The engaging wall section 111 on the rear cover 105 comprises a base portion 112 and an engaging portion 113, and is formed vertically from the circumferential edge of the rear cover 105. The base portion 112 has a height generally the same as the thickness of the front and rear covers 104 and 105 and a thickness generally twice as much as the thickness of the front and rear covers 104 and 105. The engaging portion 113 whose thickness is generally half of that of the base portion 112 is formed on the rear cover 105 with drawing gentle ascending curves starting from the center of the top edge of the rear cover 105 to the tip edge thereof, from the center of the tip edge thereof to the top and bottom edge thereof, from the center of the bottom edge to the tip edge, and lies flat to the inner face of the base portion 112. The highest part of the engaging portion 113, i.e. the corner of the rear cover 105 is designed to have a height, for example, generally one third of the height of the top wall section 108.

The other arrangements of the embodiment may be the same as those of the embodiment shown in FIGS. 1 to 4.

With the above arrangement of the invention, when the folder body 102 is closed, inner faces of the top wall section 108, tip wall section 109 and bottom wall section 110 make engagement with the outer face of the engaging portion 113 of the engaging wall section 111. This design of the folder body 102, namely the shape of a box having wall sections at every face, further improves the stiffness of the folder body 102 compared to the embodiment shown in FIGS. 1 to 4. In particular, since the cut-out portions 130 and 131 are provided on both the bottom wall section 110 which faces toward the user when the folder body 102 is opened for use and the tip wall section 109 which positions left to the user though the top wall section 108, the tip wall section 109 and the bottom wall section 110 are formed on the circumferential edge of the front cover 104, the papers bound inside the folder body 102 are accessible through the cut-out portions 130 and 131, so that there exists no obstacle to smooth turning over of pages like the embodiment shown in FIGS. 1 to 4.

Moreover, it brings about the same advantage as explained with respect to the embodiment shown in FIGS. 1 to 4.

Now referring to FIGS. 7 to 11, there is illustrated a file folder according to further embodiment of the invention. Since the file folder 201 of the embodiment has an arrangement similar to that of the file folder 101 shown in FIGS. 5 and 6, the component of the same as or otherwise corresponding to that of the above-mentioned embodiment will be referred to the same reference number and therefore no description will be given.

The front and rear covers 104 and 105 of the file folder 201 are of synthetic resin and elastically transformable along the thickness thereof. The tip wall section 109 is provided with a cut-out portion 130 for allowing elastic transformation of the front and rear covers 104 and 105 to approach each other. Between the front and rear covers 104 and 105 provided is an elastic stopper 202 which makes engagement with itself by making use of the closing action of the front and rear covers 104 and 105 as well as releases engagement by making use of the elastic transformation when the front and rear covers 104 and 105 approach each other.

More specifically, the tip wall section 109 provided on the front cover 104 of the file folder 201 has upper and down abutting portions 203 and 204 which make abutting engagement with the rear cover 105 at each the top and bottom edges thereof. The above-mentioned cut-out portion 130 is provided between the bottom edge 203*a* of the upper abutting portion 203 and the top edge 204*a* of the down abutting portion 204. The elastic stopper 202 comprises inserting members 205 and 206 provided above the bottom edge 203*a* of the down abutting portion 203 and below the top edge 204*a* of the down abutting portion 204 on the front cover 104, receiving members 207 and 208 provided on the rear cover 105 and into which the above-mentioned inserting members 205 and 206 are to be fittingly inserted when the front and rear covers 104 and 105 are closed, resistance giving elements 209 and 210 give the inserting members 205 and 206 a required resistance against being released from the receiving members 207 and 208. The inserting member 205 is a thin wall continuous to the inner faces of the top wall section 108 and the tip wall section 109 with a right-angled bent portion, and has a thickness nearly half of the thickness of the top wall section 108 and the tip wall section 109. The inserting member 206 is a thin wall continuous to the inner faces of the tip wall section 109 and the bottom wall section 110 with a right-angled bent portion, and has a thickness nearly half of the thickness of the tip wall section 109 and the bottom wall section 110. The receiving member 207 is of a concave having a right-angled bent portion formed at the corner of the tip edge and the top edge on the inner face of the rear cover 105, and into which the inserting member 205 can be fittingly inserted when the file folder 201 is closed. The receiving member 208 is of a concave having a right-angled bent portion formed at the corner of the tip edge and the bottom edge on the inner face of the rear cover 105, and into which the inserting member 206 can be fittingly inserted when the file folder 201 is closed. The resistance giving element 209 comprises an engaging projection 209*a* projecting outwardly from the side of the tip wall section 109 of the inserting member 205, and an engaging hole 209*b* provided on the receiving member 207 at a corresponding place to the engaging projection 209*a*, wherein the engaging projection 209*a* is brought into engagement with the engaging hole 209*b* by making use of a temporary elastic transformation of the material constituting covers 104 and 105 when the inserting member 205 is pushed to insert into the receiving member 207. The engaging projection 209*a* is a low projection bulging with the edges rounded and can be released from the engaging hole 209*b* by applying a pulling force more than a predetermined value to the inserting member 205 and the receiving member 207. The resistance giving element 210 comprises an engaging projection 210*a* projecting outwardly from the side of the tip wall section 109 of the inserting member 206, and an engaging hole 210*b* provided on the receiving member 208 at a corresponding place to the engaging projection 210*a*. The resistance giving element 210, wherein the engaging projection 210*a* is brought into engagement with the engaging hole 210*b* by means of a temporary elastic transformation of the material constituting covers 104 and 105 when the inserting member 206 is pushed to insert into the receiving member 208. The engaging projection 209*a* is a low projection bulging with the edges rounded and can be released from the engaging hole 210*b* by applying a pulling force more than a predetermined value to the inserting member 206 and the receiving member 208.

Figure 9:
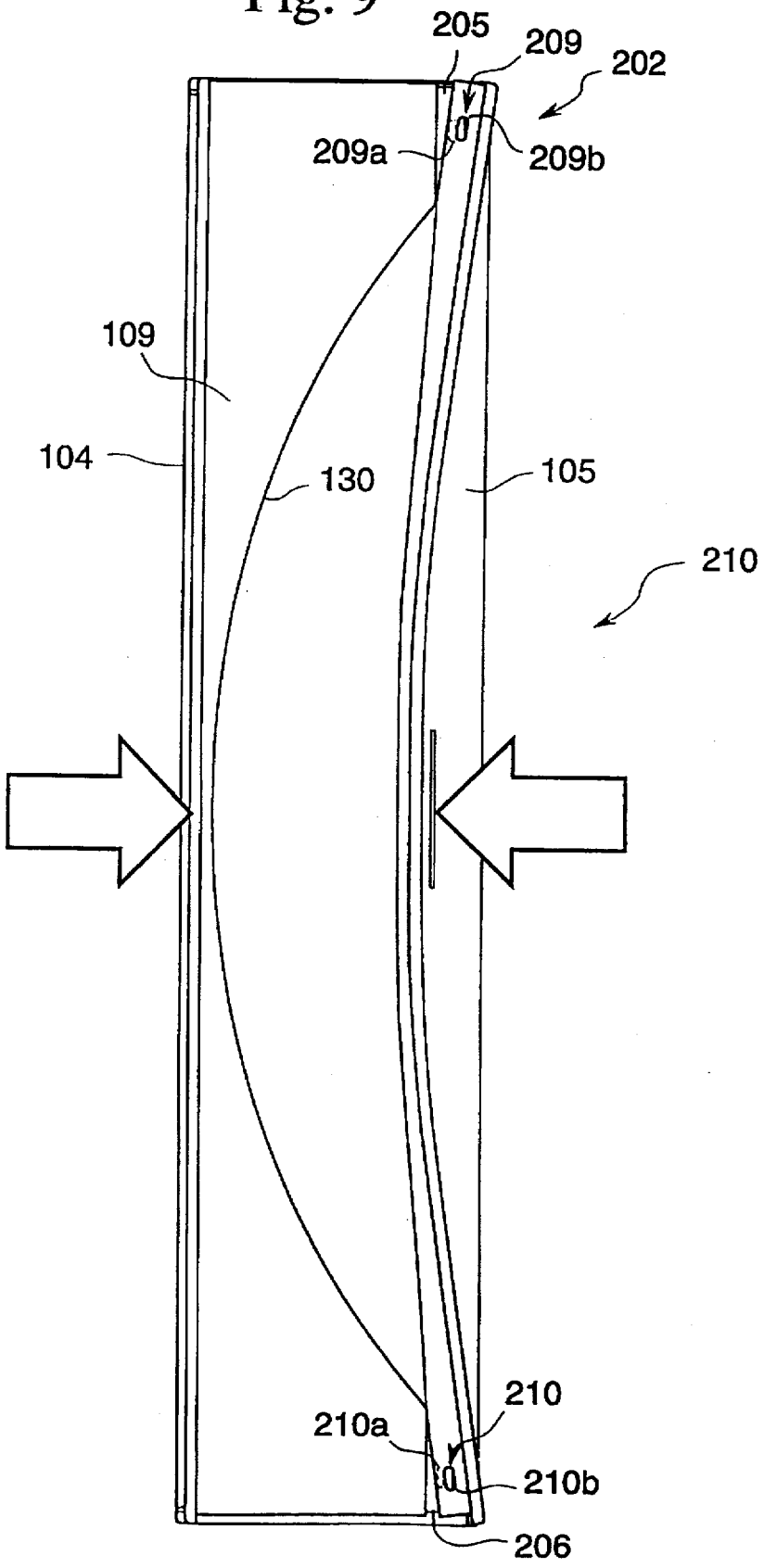
FIG. 9 is an explanatory view showing the function corresponding to FIG. 8.
Figure 10:
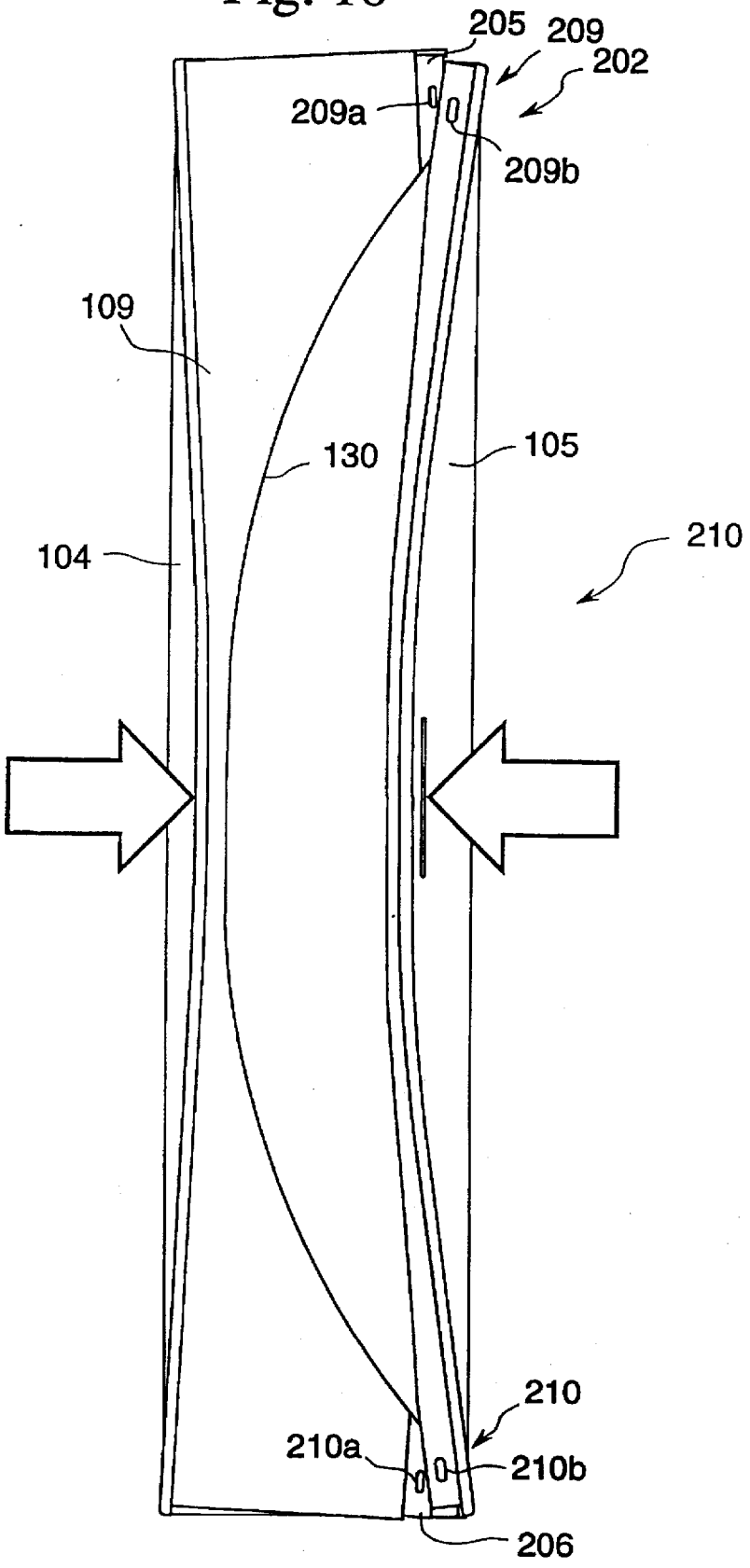
FIG. 10 is an explanatory view showing the function corresponding to FIG. 8.
Figure 11:
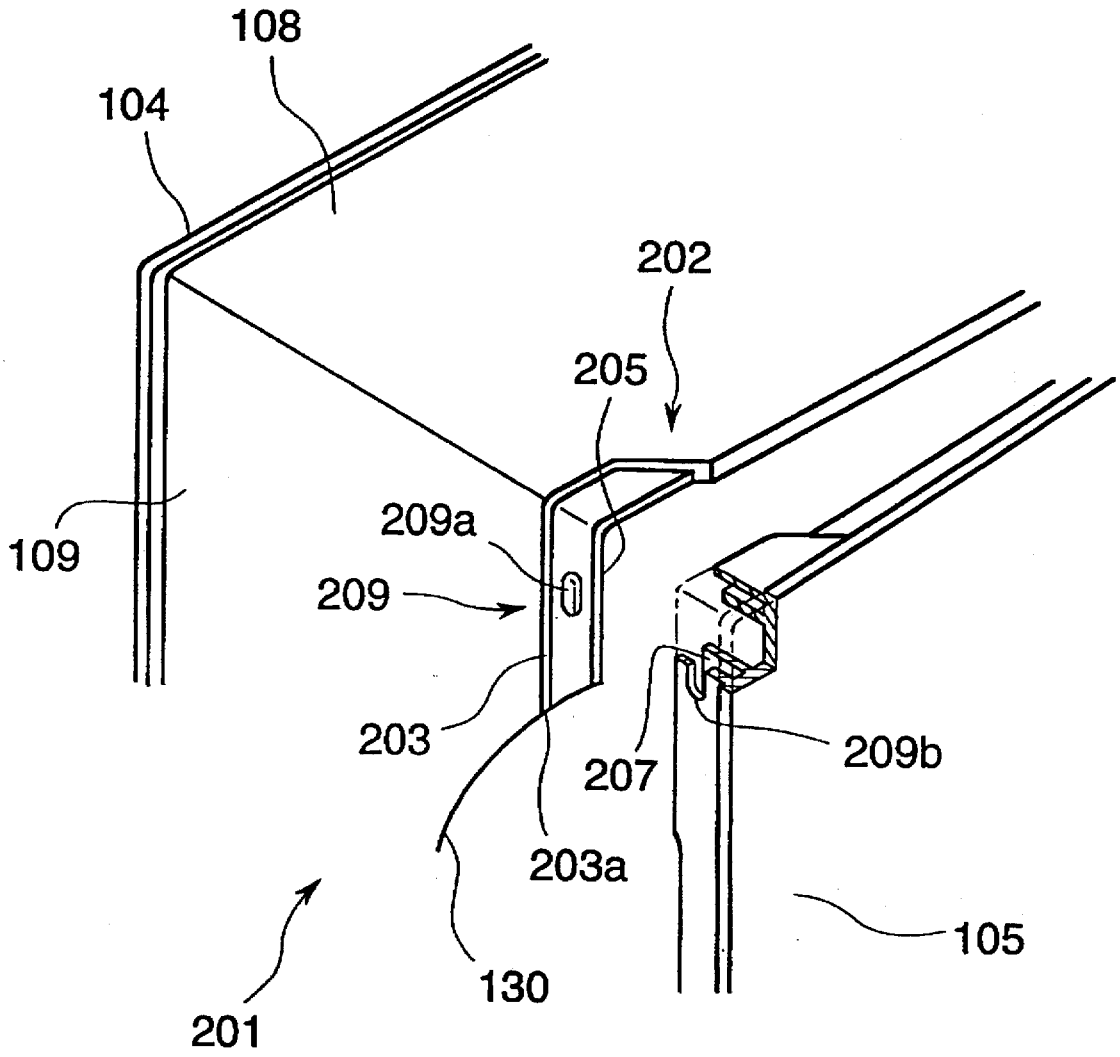
FIG. 11 is an enlarged perspective view showing a principal portion of the file folder.

In accordance with the invention, the inserting members 205 and 206 is fittingly inserted into the receiving member 207 and 208 if the file folder 201 is closed. Then as the engaging projections 209*a* and 210*a* are brought into engagement with the engaging hole 209*b* and 210*b* provided on the receiving members 207 and 208 with bringing about temporary elastic expansion of the receiving members 207 and 208, the filing folder 201 is kept not to close unexpectedly. For opening the filing folder 201, first urge the tip edges of the front rear covers 104 and 105 so as to be approached each other by, for example, pinching them. As a result of this, the rear cover 105, being easy to be transformed, begins to bend as shown in FIG. 9. Then the tip edge of the rear cover 105 is bent by making use of both the bottom edge 203*a* of the upper abutting portion 203 and the top edge 204*a* of the down abutting portion 204 as fulcra so that the portion between the bottom edge 203*a* and the top edge 204*a* moves toward the direction to approach the front cover 104 and the portions above the bottom edge 203*a* and below the top edge 204*a* move toward the direction to leave from the front cover 104. The portion above the bottom edge 203*a* in the inserting portion 205 moves toward the direction to be released from the receiving portion 207 and then the engaging projection 209*a* is released from the engagement with the engaging hole 209*b* as well as the portion below the top edge 204*a* in the inserting portion 206 moves toward the direction to be released from the receiving portion 208 and then the engaging projection 210*a* is released from the engagement with the engaging hole 210*b*. Next urge the centers of the tip edge of the front and rear covers 104 and 105 further to approach each other, then each of the inserting portions 205 and 206 will come out of the receiving portions 207 and 208 as shown in FIG. 10. Therefore the release of the pushing force applied to the front and rear covers 104 and 105 will open the front and rear covers 104 and 105 with ease.

The shape of the cut-out portion is not limited to that of the embodiments described in detail hereinabove. For example, for the file folder shown in FIGS. 5 and 6 cut-out portions may be formed at each general center of the tip wall section 109 and the bottom wall section 110 and have a width being such as at least a thumb can pass therethrough. There may be other various modifications without departing from the spirit of the invention.

POSSIBLE APPLICATIONS IN INDUSTRY

The file folder of the invention is suitable for use in storing the file folder with loose papers bound inside on a relatively long time basis in a locker or a bookshelf.

I claim:

1. A file folder comprising a pair of foldable covers each having a top edge, a tip edge and a bottom edge, a back cover integrally connected to said foldable covers, and a binding fastener fixedly provided at the inner face of said back cover or the inner face of one of said foldable covers near the back cover, characterized in that a top wall section and a tip wall section are formed along the top and tip edges of one of the foldable covers and which detachably engage with an engaging wall section formed on the other of said foldable covers such that an opening exists between said bottom edges when said folder is closed, said engaging wall section having an upright fixed wall shape which is formed at a corner of a crossing portion of the top and tip edges of said other foldable cover.

2. A file folder according to claim 1, wherein a cut-out portion which allows the foldable covers to elastically transform for approaching each other is formed on the tip wall section, and said foldable covers are elastically transformable, and is characterized by that an elastic stopper is provided between the foldable covers and portions of said elastic stopper engage with each other by making use of the closing action of the foldable covers and disengage from each other by making use of the elastic transformation of the foldable covers.

3. A file folder according to claim 2, wherein the tip wall section provided on one of the foldable covers has upper and down abutting portions which make abutting engagement with the other of said foldable covers at the top and bottom edges thereof and said portions of said elastic stopper comprise inserting members provided above the bottom edge of the upper abutting portion and below the top edge of the down abutting portion on one of the foldable covers, receiving members provided on the other of said foldable covers and into which said inserting members are to be fittingly inserted when the foldable covers are closed, and resistance giving elements which give the inserting members a required resistance against being released from the receiving members.

4. A file holder according to claim 3, wherein a label mount portion is provided on each of said back cover and said top wall section.

5. A file folder according to claim 3, wherein a finger access portion is provided on each of said back over and said top wall section.

6. A file folder according to claim 2, wherein a label mount portion is provided on each of said back cover and said top wall section.

7. A file folder according to claim 2, wherein a finger access portion is provided on each of said back cover and said top wall section.

8. A file folder according to claim 1, wherein a label mount portion is provided on each of said back cover and said top wall section.

9. A file folder according to claim 8, wherein a finger access portion is provided on each of said back cover and said top wall section.

10. A file folder according to claim 1, wherein a finger access portion is provided on each of said back cover and said top wall section.

11. A file folder comprising a pair of foldable covers, a back cover integrally connected to said foldable covers, and a binding fastener fixedly provided at the inner face of the back cover or the inner face of one of the foldable covers near the back cover, characterized in that a top wall section, a bottom wall section and a tip wall section are formed along the top, bottom and tip edges of one of the foldable covers and which detachably engage with the other of said foldable covers and that a cut-out portion which draws a gentle ascending curve and extends close to the inner face of one of the foldable covers is formed in the bottom wall section which faces the user when the file folder is opened for use and such that an opening exists in said bottom wall section when said folder is closed.

12. A file folder according to claim 11, wherein a cut-out portion which allows the foldable covers to elastically transform for approaching each other is formed on the tip wall section, and said foldable covers are elastically transformable, and is characterized by that an elastic stopper is provided between the foldable covers and portions of said elastic stopper engage with each other by making use of the closing action of the foldable covers as well as disengage from each other by making use of the elastic transformation of the formable covers.

13. A file folder according to claim 12, wherein the tip wall section provided on one of the foldable covers has upper and down abutting portions which make abutting engagement with the other of said foldable covers at the top and bottom edges thereof and said portions of said elastic stopper comprise inserting members provided above the bottom edge of the upper abutting portion and below the top edge of the down abutting portion on one of the foldable covers, receiving members provided on the other of said foldable covers and into which said inserting members are to be fittingly inserted when the foldable covers are closed, and resistance giving elements which give the inserting members a required resistance against being released from the receiving members.

14. A file folder according to claim 13, wherein a label mount portion is provided on each of said back cover and said top wall section.

15. A file folder according to claim 14, wherein a finger access portion is provided on each of said back cover and said top wall section.

16. A file folder according to claim 13, wherein a finger access portion is provided on each of said back cover and said top wall section.

17. A file folder according to claim 11, wherein a label mount portion is provided on each of said back cover and said top wall section.

18. A file folder according to claim 11, wherein a finger access portion is provided on each of said back cover and said top wall section.

* * * * *